US005121976A

United States Patent [19]

Haab et al.

[11] Patent Number: 5,121,976

[45] Date of Patent: Jun. 16, 1992

[54] FURNITURE ARTICLE WITH A DOOR SLIDABLE INTO DOOR COMPARTMENT

[76] Inventors: Karl Haab, Obere Weidstrasse 7, CH-6343 Rotkreuz, Switzerland; Otto Haab, Im Erspach, CH-8932 Mettmenstetten, Switzerland

[21] Appl. No.: 493,548

[22] Filed: Mar. 14, 1990

[30] Foreign Application Priority Data

Mar. 14, 1989 [CH] Switzerland ..... 943/89

[51] Int. Cl.[5] ..... A47B 88/00

[52] U.S. Cl. ..... 312/322; 49/254

[58] Field of Search ..... 312/110, 109, 322, 331, 312/334, 332; 49/254, 257

[56] References Cited

U.S. PATENT DOCUMENTS

| | | | |
|---|---|---|---|
| 972,412 | 10/1910 | Taussig | 49/257 |
| 4,815,797 | 3/1989 | Haab et al. | 312/322 |
| 4,821,375 | 4/1989 | Kozon | 312/332 |
| 4,910,916 | 3/1990 | DuBach et al. | 49/257 |
| 4,945,972 | 8/1990 | Takeuchi | 312/322 |

FOREIGN PATENT DOCUMENTS

| | | |
|---|---|---|
| 0254041 | 6/1987 | European Pat. Off. . |
| 933584 | 10/1951 | Fed. Rep. of Germany . |
| 2045763 | 6/1972 | Fed. Rep. of Germany . |
| 2405669 | 10/1978 | France . |

*Primary Examiner*—Gerald A. Anderson
*Attorney, Agent, or Firm*—Carl J. Evens

[57] ABSTRACT

A door for a furniture article which is lowerable into a door compartment is fastened to a door-carrying bar which is fixed to a scissors-assembly having two beams anchored on one side wall of the door compartment. To facilitate the adjustment of the scissors-assembly, an upper anchor assembly of one of the beams of the scissors-assembly is located on a fixing member, which is connected via the one side wall to an adjusting member so that, on pivoting the adjusting member about a screw, the fixing member is also moved. The door-carying bar is guided on two opposite rails, which are screwed to bushes which are in turn screwed into the one side wall for adjusting the spacing between the wall and a respective rail. For maintaining the spacing between the door and a second wall, facing the first side wall, the door-carrying bar carries a roller which presses against a plastic plate provided in the vicinity of the leading edge of the first side wall when the door is not lowered. A setscrew is provided in the door to permit a vertical displacement of the door-carrying bar with respect to the scissors-assembly.

30 Claims, 5 Drawing Sheets

FIG. 2a
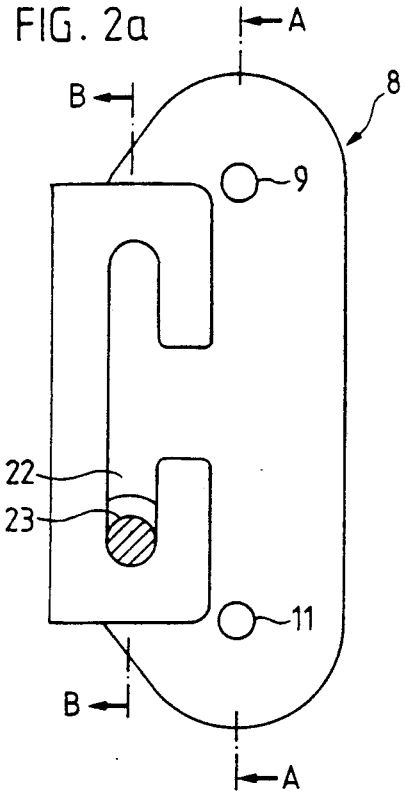
FIG. 2b
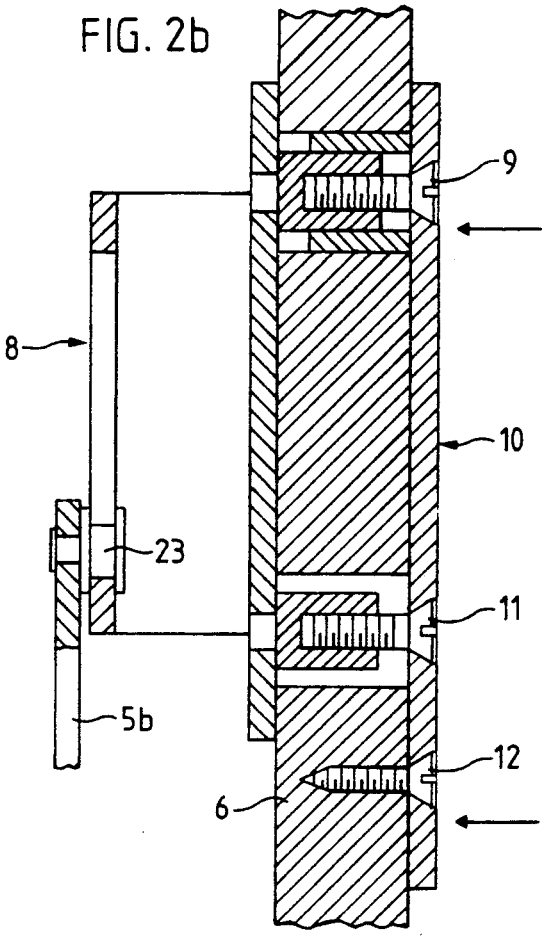
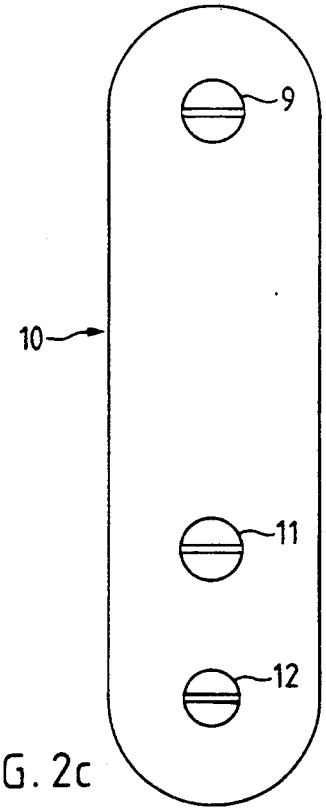
FIG. 2c
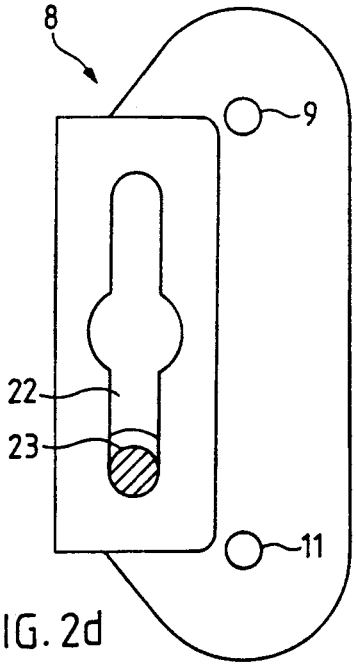
FIG. 2d

FURNITURE ARTICLE WITH A DOOR SLIDABLE INTO DOOR COMPARTMENT

BACKGROUND OF THE INVENTION

The present invention relates to a furniture article having a door, which can be moved down from a use position into a door compartment with at least one side wall, and having a vertical fastening bar, to which the door is connected, and a scissors-assembly, the beams of which are connected to the first side wall of the door compartment and to the fastening bar in each case by two respective anchor assemblies, one of which is fixed and the other is vertically displaceable.

Such a piece of furniture is known from U.S. Pat. No. 972,412. Experience has shown that in the case of the lowerable or slidable doors as described in the aforementioned specification, particularly when the door is subsequently fitted, as is nowadays conventionally the case, even when great care is taken during the fitting of the door, problems occur linked with minor changes in the geometry of the retaining or holding device, such as result from loading by various forces and moments applied to the door.

EP-A1-254041 discloses another furniture article of the foregoing type. This very practical solution offers the possibility of subsequently adjusting various parameters of the article of furniture. In particular, it is possible to laterally displace the guide rails, which are fitted to the top and bottom of the door compartment in this known arrangement, which permits an adjustment reliably preventing any jamming of the scissors-type connection. However, the adjustment can only take place following the assembly of the door compartment and requires manipulations in the interior thereof.

SUMMARY OF THE INVENTION

It is an object of the present invention to provide a furniture door, which can be flexibly used and is robust and, if necessary, can be adapted to given requirements with limited expenditure. In particular, the slope of the fastening bar must be adjustable from the side of the first side wall facing the door compartment. This is particularly important if, as is often the case, only one side wall of the door compartment with the retaining mechanism provided therein is delivered and the actual fitting of the door into the furniture article takes place at a later date.

The advantages resulting from the invention are in particular that the furniture article according to the invention is very suitable for later assembly with subsequent adjustment. The one side wall with the retaining mechanism can be easily connected to the parts, which are possibly manufactured by other manufacturers, such as the top, bottom and the other side wall of the door compartment, as well as the actual door and so as to permit the necessary adaptations. With the furniture article according to the invention, it is particularly possible to correct hanging outwards of the door, which can easily occur particularly when it is subsequently fastened, without parts having to be disassembled and without tiresome manipulations in the door compartment, which are typically necessary.

In a preferred embodiment of the furniture article according to the invention, a retaining mechanism, together with the guide rails, can be assembled in a ready-to-fit manner at the factory, which ensures a more accurate installation than in the case of the subsequent fitting of the guide rails during the assembly of the furniture article. This ensures a relatively robust retaining mechanism. Possibilities are also provided for constructing the guide rails in an adjustable manner. In the case of an inventive construction based on the use conditions, jamming of the scissors-assembly can be reliably prevented.

The aforementioned objects, features and advantages of the invention will, in part, be pointed out with particularity, and will, in part, become obvious from the following more detailed description of the invention, taken in conjunction with the accompanying drawing, which form an integral part thereof.

BRIEF DESCRIPTION OF THE DRAWINGS

FIG. 2*a* is an enlarged front view of an upper anchor arrangement of a scissors-assembly on the first side wall in the left-hand upper corner of FIG. 1, with one scissors-assembly beam omitted;

FIG. 2*b* is a sectional view taken along line A—A and in part along line B—B of FIG. 2*a;*

FIG. 2*c* is a plan view of a detail of FIG. 2*b* taken in the direction indicated by arrows;

FIG. 2*d* is a front view of a further embodiment of the upper anchor arrangement of the scissors-assembly on the first side wall, corresponding to FIG. 2*a;*

DETAILED DESCRIPTION OF THE PREFERRED EMBODIMENTS

Figure 1:
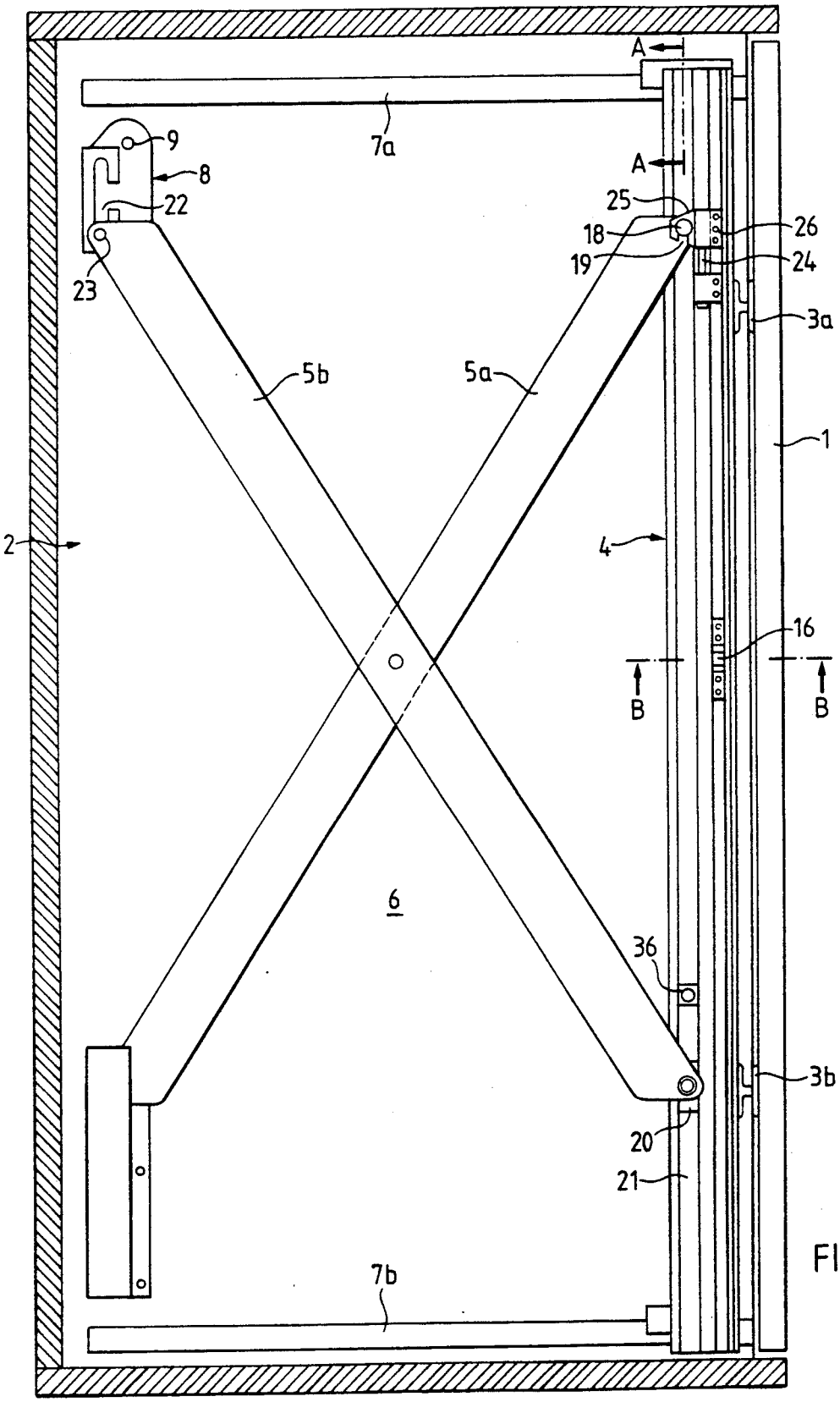
FIG. 1 is a front view of a door compartment according to the invention, with one of two side walls omitted.

Referring now to the drawings, they show a furniture article with a door 1 which is slidable or lowerable into a door compartment 2. The door 1 is fastened by means of cup hinges 3*a*, 3*b* to a door-carrying bar 4, which is carried by a scissors-assembly or arrangement, beams 5*a*, 5*b* of which are connected with the bar by two anchor arrangements, of which the top anchor arrangement is fixed and the bottom anchor arrangement is vertically displaceable. The beams are also connected by the anchor arrangements to a first side wall 6 of the door compartment 2. It is naturally also possible for the upper anchor arrangement to be displaceable and the lower anchor to be fixed. However, the preferred arrangement has the advantage that the effect of the weight of the scissors-assembly assists the lowering of door 1 and, prior to the fastening thereof, ensures that the scissors-assembly remains lowered in the door compartment 2. FIG. 1 shows the furniture article with an unlowered, closed door 1, the scissors-assembly being open. Door 1 and bar 4 are located in the use position. If the door 1 is completely open, it can be slid or lowered into the door compartment 2, with the scissors-assembly collapsing and the door-carrying bar 4, guided on an upper rail *7a* and a lower rail *7b*, being slid to the rear end of the door compartment 2.

According to the invention the fixed anchor arrangement of the beam *5b* on the first side wall 6 is located on a fixing or fastening member 8 (FIGS. 1, *2a*, *2b*, *2c*, *2d*), which is connected via the same by means of a screw connection 9 to an adjusting member 10 (FIG. *2b*) in such a way that the screw connection 9 forms a common fulcrum for fixing member 8 and adjusting member 10. In addition, the fixing member 8 and the adjusting member 10 are connected to each other by a further screw connection 11, which passes through the first side wall 6 with a lateral or peripheral clearance, so that with the screw connection 11 loosened, the fixing and adjusting members 8, 10 can be jointly pivoted about their common fulcrum. However, if after the fastening of the door 1, it is found that it hangs out from the furniture article to a certain extent then the screw connection 11 is loosened and the lower end of adjusting member 10 is pressed rearwards. The fixing member 8 is carried therealong and, consequently, the upper anchoring point of the scissors-assembly is rearwardly displaced. As a result the door-carrying bar 4 and door 1 are aligned. When the adjustment is completed the screw connection 11 is tightened and forms a clamping connection between the fixing member 8 and the adjusting member 10, on the one hand, and the first side wall 6, on the other hand. In addition, the adjusting member 10 is secured against pivoting about the fulcrum by a screw 12. Thus, the adjustment can be easily performed from outside the door compartment 2 with the retaining mechanism and the fastened door 1 completely assembled.

Figure 3:
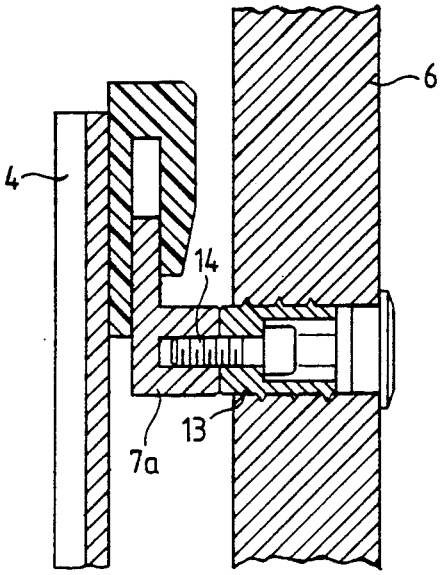
FIG. 3 is a sectional view taken along line A—A in FIG. 1, on enlarged scale.

The function of the upper rail *7a* and the lower rail *7b* is to precisely guide the door-carrying bar 4 and consequently prevent twisting and jamming of the scissors-assembly *5a*, *5b*. Both rails *7a* and *7b* are mounted on the one of the two side walls, namely the wall 6 shown in the drawing. This has the advantage that a first adjustment of the rails *7a*, *7b* can take place at the time of the assembly of the retaining mechanism by the manufacturer and not at the time of assembling the door compartment 2. However, if a readjustment, after assembly, is still necessary, the rails *7a*, *7b* are fixed to the side wall 6 so that their spacing from wall 6 is adjustable from the side of the first side wall 6 facing the door compartment 2. Rails *7a*, *7b* are fixed by bushes 13 and screws 14 (FIG. 3) to the side wall 6. Each bush 13 has an external thread and is inserted in wall 6. The bushes 13 are screwed to the particular rail, e.g. the upper rail *7a*. If it is necessary to modify the spacing of rail *7a* from the side wall 6, then the screw 14, which is in engagement with the rail *7a* and the end portion of bush 13, is loosened, the bush 13 is displaced by turning, e.g. by means of a hexagon socket wrench, and then screw 14 is tightened again. This permits a readjustment without tiresome manipulations in the door compartment 2, which saves a considerable amount of additional work.

An alternative construction of rail *7a* shown in FIGS. *6a*, *6b* facilitates the completion of the guidance of the door-carrying bar 4 by the guidance of door 1, which is produced by a guide member 27, which engages with rail *7a*, on lowering the door. Thus, uncontrolled lateral movements of the door are reliably prevented. Another possibility of guiding door 1 is provided by a guide plate 28, which engages in a slot 29 in the top wall of door 1. Both possibilities are shown in FIG. *6b*. They can be readily combined, but one of them is normally sufficient and adequate. Identical guides can be provided at the lower end of door 1.

Figure 7:
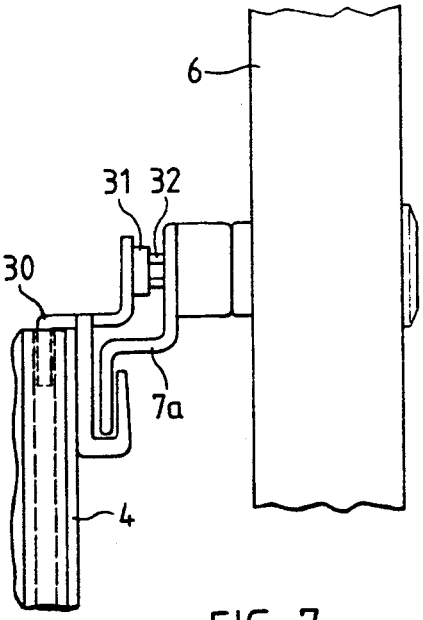
FIG. 7 is a side view of the door-carrying bar of an alternative embodiment and its guidance on the upper rail.
Figure 8B:
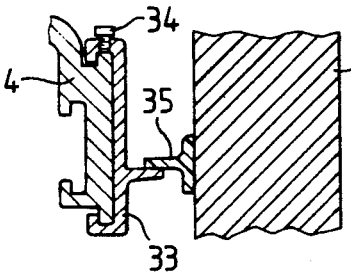
FIG. 8*b* is a sectional view taken along line D—D in FIG. 8*a*.

FIG. 7 shows an alternative embodiment of the guidance assembly of the door-carrying bar 4 appropriate for the above-described construction of rail *7a*. The door-carrying bar 4 carries a mounted strut-like guide 30, which is in engagement with rail *7a* and carries a snap device 31 which, together with a screw 32 mounted on rail *7a*, forms a snap lock effective against an undesired sliding back of the door-carrying bar 4 out of the use position into the door compartment 2. Due to the fact that this snap lock acts between the door-carrying bar 4 and the rail *7a*, it does not have to be adjusted on modifying the spacing of rail *7a* from the first side wall 6. Although a guide rail for guiding the door 1, as shown in FIGS. *6a*, *6b* is not shown here, it can easily be provided.

A stop member 33 (FIGS. *8a*, *8b*) fixed by means of a clamping screw 34 to bar 4 prevents the latter from being drawn out of the door compartment 2 beyond the use position. It cooperates with a stop element 35 fixed to the first side wall 6. On loosening the clamping screw 34, the stop member 33 can be slid along the bar 4 out of the area in which it cooperates with the stop element 35 or slips automatically out of said area under the influence of gravity. The door-carrying bar 4 can then be drawn out of the door compartment 2 for adjustment or other maintenance purposes. For securing the bar 4 in this position, it is possible to provide another not shown snap lock between the door compartment 2 and the bar 4, so that the latter does not slide back into the compartment 2.

Figure 4:
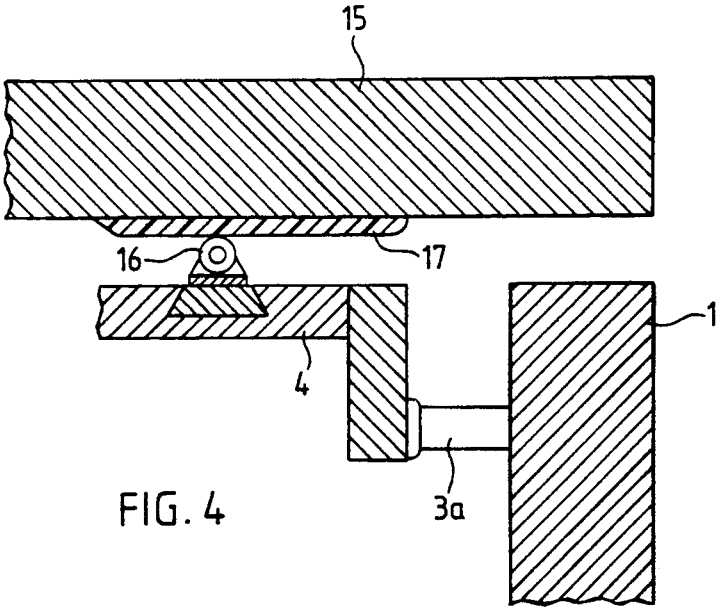
FIG. 4 is a sectional view taken along line B—B in FIG. 1, on enlarged scale.
Figure 6A:
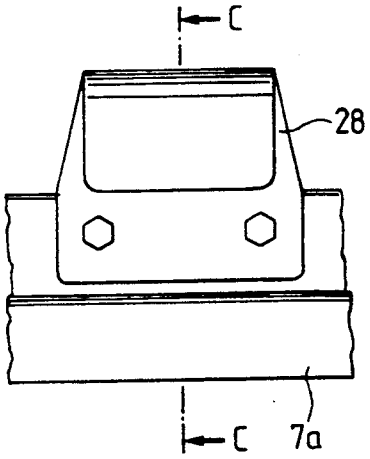
FIG. 6*a* is a side view of an upper rail of a further embodiment, with a guide plate for guiding the not-shown door, on lowering it into the door compartment.
Figure 6B:
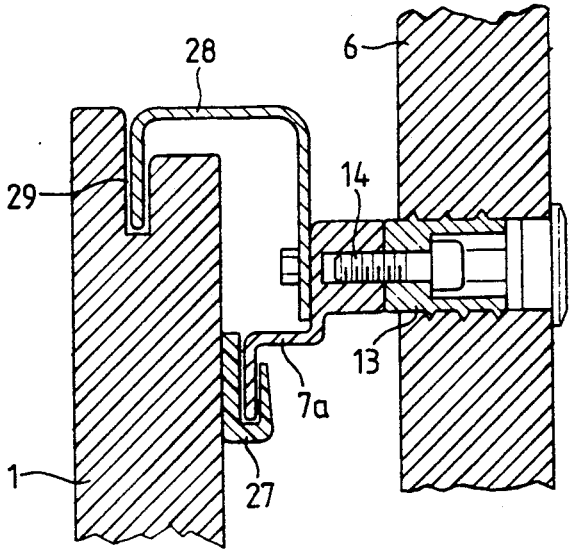
FIG. 6*b* is a sectional view taken along line C—C in FIG. 6*a*, with the door also shown.
Figure 8A:
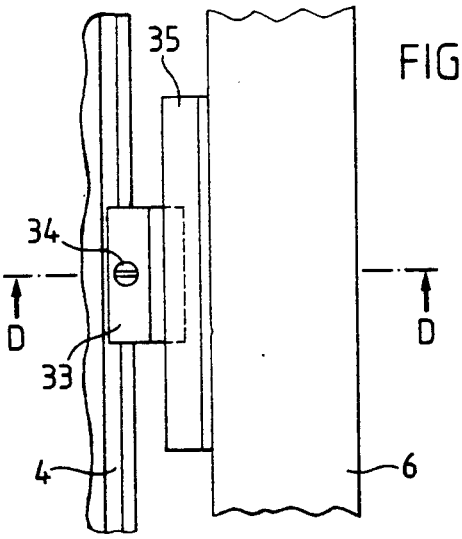
FIG. 8*a* shows a stop preventing the drawing of the bar shown in FIG. 7 out of the door compartment, in a sectional view.

Normally the door compartment 2 is limited on the side opposite to the first side wall 6 by a second side wall 15 shown in FIG. 4. If the distance between the second side wall 15 and the first side wall 6 is too great, then a disturbing gap occurs, whereas if it is too small the edge of door 1 rubs against the second side wall 15 during opening and closing, which can lead to considerable damage to the door 1, e.g. splintering of the veneer. Thus, a roller 16 is fixed to the door-carrying bar 4, which roller can be displaced along a dovetail groove of bar 4 and can be fixed to the bar 4 by means of screws. The roller 16 is spaced from the second side wall 15, so that annoying noise is avoided during the insertion or drawing out of the door 1. When door 1 is drawn out, the roller 16 presses against a plastic plate 17 fitted to the second side wall 15 in the vicinity of the front edge thereof. Plate 17 ensures an adequate spacing between the side wall 15 and door 1, even if the spacing is actually too small. In order to increase a tolerance range, it is also possible to provide a mounting support for roller 16, which would make it possible to modify its distance from the bar 4.

Figure 9:
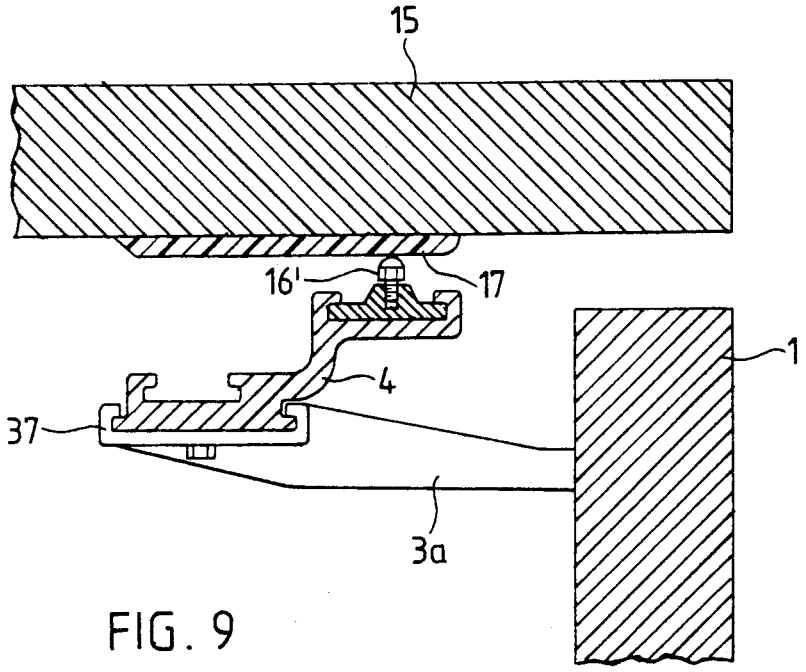
FIG. 9 is a sectional view similar to that of FIG. 4, with the door-carrying bar of FIG. 7, and illustrating the fastening of the door to the bar.

In an alternative construction shown in FIG. 9, roller 16 is replaced by a screw 16', which has a rounded head abutting against plate 17 and which facilitates the adaptation to the spacing with respect to the second side wall 15. FIG. 9 also shows an alternative construction of the door-carrying bar 4, in which hinges 3*a* an 3*b* are provided having an identical construction. Each hinge is fixed to the bar 4 by means of a retaining part 37, which embraces a protruding part of the bar 4 in a claw-like manner. This construction saves space compared with that of FIGS. 1 and 4.

Figure 5:
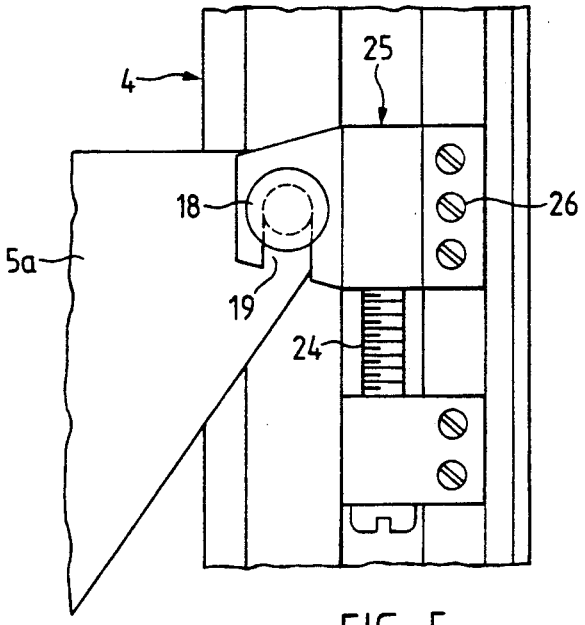
FIG. 5 is a larger-scale view of an upper anchor arrangement of the scissors-assembly on a bar carrying the door in the right-hand upper corner of FIG. 1.

The anchoring of the scissors-assembly (FIGS. 1, 5) to the door-carrying bar 4 is advantageously obtained in that the upper fixed anchor arrangement of beam 5*a* is formed by a bolt 18 anchored to the beam 5*a* and a slot 19 which is open downwardly or may be widened as in FIG. 2*d*. Slot 19 is formed in a carrier element 25 fixed to the bar 4. A vertically displaceable plastic slide 20 (FIG. 1) is connected in a rotary manner to the beam 5*b* and is guided in a downwardly open dovetail-shaped groove 21 in the bar 4. Since after moving the stop member 33 out of the vicinity of the stop element 35, the bar 4 can be completely drawn out of the door compartment 2, it can be equally easily detached from the scissors-assembly 5*a*, 5*b*.

In the same way the anchoring system for the beam 5*b* of the scissors-assembly on the top of the first side wall 6 is formed by an upwardly open or widened slot 22 (the first variant permitting easier assembly and disassembly, whilst the latter is mechanically more stable) provided in the fixing member 8 and a bolt 23 (FIG. 1) fixed to the beam 5*b*. At the bottom of the beam 5*a*, for anchoring of the scissors-assembly system to the bar 4, a further slide member is connected in a rotary manner to the beam 5*a*, which is guided in an upwardly open dovetail-shaped groove, which in this case is terminated at its lower end by a sound reducing plastic stop, which permits the easy unhinging of the scissors-assembly.

To ensure that an excessive drawing of the bar 4 out of the door compartment 2 does not lead to the unintentional drawing of the beam 5*a* out of the displaceable anchor arrangement on the first side wall 6, a stop 36 (FIG. 1) is fitted to the bar 4, which limits the upward movement of slide 20 in the dovetail-shaped groove 21. Stop 36 is fixed in detachable manner, e.g. by means of a clamping screw, which facilitates an intentional unhinging of the scissors-assembly 5*a*, 5*b*, as described hereinbefore.

To ensure that the scissors-assembly takes up a minimum amount of depth of the door compartment 2 with door 1 lowered, the anchor arrangements of the scissors-assembly on the door-carrying bar 4 and on the first side wall 6 are fitted to the outer corners of beams 5*a*, 5*b*, respectively.

The many possible adjustments are supplemented by a set or adjusting screw 24, which makes it possible to vertically displace the bar 4 with respect to the support or carrier element 25 suspended on bolt 18 by means of slot 19. It is merely necessary to loosen screws 26, which secure the carrier element 25 against a vertical displacement of bar 4, adjust the position of the bar 4 by turning the set screw 24 and then re-tightening screws 26. As described hereinbefore, for the purpose of this adjustment, the bar 4 can naturally be drawn out of the door compartment 2, which makes work much easier.

There has been disclosed heretofore the best embodiment of the invention presently contemplated. However, it is to be understood that various changes and modifications may be made thereto without departing from the spirit of the invention.

What is claimed is:

1. A furniture article in combination with a door which slides from a use position into a door compartment of the furniture article, said door compartment having at least one side wall, the combination comprising a substantially vertical door-carrying bar connected to said door; a scissors-assembly positioned in said compartment and having two beams connected to said side wall by two first anchor means and to said bar by two second anchor means, one of said two first anchor means and one of said two second anchor means having a fixed axis about which the beam pivots and another of said two first anchor means and another of said two second anchor means having a vertically displaceable axis about which the beam pivots, at least one of said anchor means connecting said scissors-assembly to said one side wall including a fastening member with two ends positioned on one side of said side wall and a movable adjusting member with two ends positioned on an opposite side of said side wall and one end of side adjusting member connected through said side wall to one end of said fastening member, said connection of said fastening member and said adjusting member acting as a common fulcrum axis so that upon pivotal movement of said adjusting member about said fulcrum axis, the other end of said fastening member is displaced along said side wall.

2. The combination according to claim 1, wherein said fixed axis anchor means is the means which is connected to said adjusting member.

3. The combination according to claim 2, wherein said fastening member and said adjusting member are connected to each other by means which are passed with a lateral clearance through an opening in said one side wall below said common fulcrum, in such a way that pivoting movements of said fastening member about the fulcrum are possible.

4. The combination according to claim 3, wherein said means to connect said fastening member and said adjusting member to each other includes a screw operable from outside said door compartment and wherein said screw, said adjusting member and said fastening member form a detachable clamping connection to said one side wall.

5. The combination according to claim 2, wherein said adjusting member is fixed by a screw to said one side wall against pivoting about the fulcrum.

6. The combination according to claim 1, further comprising rail means for guiding said door-carrying bar, said rail means including an upper rail fixed to said one side wall and a lower rail which is also fixed to said one side wall.

7. Combination according to claim 6, wherein said upper and lower rails are fixed to said one side wall by connecting means which permit an adjustment of a spacing of each of said rails from said one side wall at the side thereof facing said door compartment.

8. Combination according to claim 7, wherein said connecting means include bushes having an external thread by which they are anchored in said one side wall, said bushes being displaceable by turning and being each screwed to one of said rails.

9. Combination according to claim 8, wherein said door has at least one guide member which is engageable with one of said rails as the door is slid into said compartment.

10. Combination according to claim 9, further comprising a guide plate provided in the vicinity of the opening in the door compartment, said guide plate, on lowering said door into said compartment engaging in a groove formed in one of a bottom and top end of said door.

11. Combination according to claim 10, wherein said at least one guide plate is fixed to one of said rails.

12. Combination according to claim 6, wherein a snap lock is provided between said door-carrying bar and said door compartment for preventing a movement of said bar out of the use position and into said door compartment when required.

13. Combination according to claim 12, wherein said snap lock acts between said door-carrying bar and at least one of said rails.

14. Combination according to claim 6, further comprising a stop member connected to said door-carrying bar in such a way that, following the release of a fixture provided thereon, said stop member is displaceable over a certain position range along said bar, and a stop element fixed to said one side wall and cooperating with said stop member, when it is located in a specific portion of said position range, so that a removal of said bar from said door compartment is blocked.

15. Combination according to claim 6, wherein the displacement of said displaceable axis anchor means of said scissors-assembly on said bar is upwardly limited by a stop detachably fixed to said bar against displacement along the same.

16. Combination according to claim 15, wherein said stop is fixed in a position, which allows a drawing of said bar out of said door compartment but prevents a release of said scissors-assembly from the displaceable anchor means on said one side wall.

17. Combination according to claim 1, further comprising another side wall of said door compartment facing said one side wall, at least one spacer fitted to said door-carrying bar and facing and spaced from said another side wall, and at least one plate provided in the area of said another side wall adjacent to a leading edge thereof and with which said spacer is in contact when said door is not lowered into said compartment.

18. Combination according to claim 17, wherein said spacer is displaceable along said door-carrying bar after releasing a fixture provided thereon.

19. Combination according to claim 17, wherein said spacer is constructed as a roller.

20. Combination according to claim 18, wherein said spacer is constructed as a roller.

21. Combination according to claim 18, wherein said spacer is constructed as a screw.

22. Combination according to claim 1, further comprising hinges provided on said door and fixed to the door-carrying bar by a claw-like retaining member embracing at least part of said door-carrying bar.

23. Combination according to claim 1, wherein one of said fixed axis anchor means connecting said scissors-assembly to said door-carrying bar includes a bolt anchored to one of said beams of said scissors-assembly and a support element having a slot and fixed to said bar, and said displaceable axis anchor means including a slide connected in a rotary manner to another of said beams and guided in a dovetail-shaped groove open at at least one end, so that said bar can be unhinged.

24. Combination according to claim 23, wherein said slot is open downwardly.

25. Combination according to claim 23, wherein another of said fixed axis anchor means connecting said scissors-assembly to said one side wall is formed by a slot provided in said fastening member and a bolt engaging in said slot and anchored to another of said beams of said scissors-assembly, and another vertically displaceable axis anchor means including a slide connected in a rotary manner to said one beam of said scissors-assembly and guided in an upwardly open dovetail-shaped groove, so that said scissors-assembly can be unhinged.

26. Combination according to claim 25, wherein said slot has a widened portion.

27. Combination according to claim 1, wherein said anchor means of said scissors-assembly on said one side wall and on said bar act on outer corners of said beams.

28. Combination according to claim 1, wherein a part of said bar carrying said door is vertically displaceable with respect to said scissors-assembly.

29. A furniture article in combination with a door which slides from a use position into a door compartment of the furniture article, said door compartment having at least one side wall, the combination comprising a door-carrying bar substantially vertically connected to said door;

a scissors-assembly positioned in said compartment and having two beams connected to said one side wall by two first anchor means and to said bar by two second anchor means, one of said two first anchor means and one of said two second anchor means providing a fixed axis about which the beams pivot, and the other one of said two first anchor means and the other of said two second anchor means providing a slidably vertically displaceable axis about which said beams pivot;

an inside fastening member having two ends positioned on the inside of said side wall and having means for fixing at least one of said anchor means of said scissors-assembly to said side wall;

an adjusting member having two ends positioned on the outside of said side wall and connected through said side wall to said inside fastening member at a common pivot point and at a second point which upon angular movement of said adjusting member about the common pivot point is displaced and moves said at least one of said anchor means of said scissors-assembly frontwards or backwards with respect to said one side wall to provide adjustment to the door with respect to the furniture article from the outside of the door compartment during its assembly as well as after its assembly.

30. A furniture article in combination with a door which slides from a use position into a door compartment of the furniture article, said door compartment having at least one side wall, the combination comprising a substantially vertical door-carrying bar connected to said door;

a scissors-assembly positioned in said compartment and having two beams connected to said one side wall by two first anchor means and to said bar by two second anchor means, one of said two first anchor means and one of said two second anchor means providing a fixed axis about which the beams pivot and another of said two first anchor means and another of said two second anchor means providing a vertically displaceable axis about which said beams pivot, at least one of said anchor means connecting said scissors-assembly to said one side wall including a fastening member with two ends positioned on one side of said side wall and a movable adjusting member with two ends positioned on an opposite side of said side wall, one end of said adjusting member connected to one end of said fastening member, said fastening member and said adjusting member being pivotably connected at a common fulcrum axis through said one side wall so that upon pivotal movement of said adjusting member about said fulcrum axis said fastening member is displaceable at least horizontally along said one side wall;

the other end of said fastening member and the other end of said adjusting member also connected to each other by means which are passed with a lateral clearance through an opening in said one side wall below said common fulcrum point said lateral clearance allowing displacement of said other ends;

said means to connect said one end of said fastening member and said one end of said adjusting member to each other including a screw operable from outside said door compartment and wherein said screw, said adjusting member and said fastening member form a detachable clamping connection to said one side wall; and said adjusting member being fixed by a screw to said one side wall against pivoting about the fulcrum after the adjustment is complete.

* * * * *